US008584290B2

(12) United States Patent
Asbjørn

(10) Patent No.: US 8,584,290 B2
(45) Date of Patent: Nov. 19, 2013

(54) CONSTRUCTION OF A WALKWAY

(75) Inventor: Nes Asbjørn, Veitastrond (NO)

(73) Assignee: Cruise Ventures AS, Veitastrond (NO)

( * ) Notice: Subject to any disclaimer, the term of this patent is extended or adjusted under 35 U.S.C. 154(b) by 0 days.

(21) Appl. No.: 13/382,209

(22) PCT Filed: Jul. 6, 2010

(86) PCT No.: PCT/NO2010/000270
§ 371 (c)(1),
(2), (4) Date: Feb. 22, 2012

(87) PCT Pub. No.: WO2011/005112
PCT Pub. Date: Jan. 13, 2011

(65) Prior Publication Data

US 2012/0137450 A1 Jun. 7, 2012

(30) Foreign Application Priority Data

Jul. 6, 2009 (NO) ..... 20092548

(51) Int. Cl.
*B65G 65/00* (2006.01)

(52) U.S. Cl.
USPC ..... 14/27; 114/362

(58) Field of Classification Search
USPC ..... 14/2.6, 27; 114/362
See application file for complete search history.

(56) References Cited

U.S. PATENT DOCUMENTS

| | | | | | |
|---|---|---|---|---|---|
| 3,747,354 | A * | 7/1973 | Macomber | 405/220 |
| 3,897,741 | A * | 8/1975 | Martini | 114/266 |
| 4,145,786 | A * | 3/1979 | Myers | 14/27 |
| 4,169,296 | A * | 10/1979 | Wipkink et al. | 14/71.1 |
| 4,386,441 | A * | 6/1983 | Lundholm | 14/27 |
| 5,649,333 | A * | 7/1997 | Chernjawski | 14/27 |
| 2003/0056708 | A1 * | 3/2003 | Vollmerhausen | 114/258 |
| 2005/0061227 | A1 * | 3/2005 | Ostreng et al. | 114/362 |

* cited by examiner

*Primary Examiner* — Raymond W Addie
(74) *Attorney, Agent, or Firm* — Francis C. Hand; Carella, Byrne, et al

(57) ABSTRACT

A flexible, floating walkway (10) is described to make it possible to securely transport people and/or goods between installations at sea, such as ships, and land (30,20). The walkway is characterized in that it comprises bridge elements (50) coupled in between floating elements (60A, 60B, 60C) fitted with horizontal and vertical segments, so that the floating elements can be pulled out during use to couple the installations (30,20) (20) and folded up when the walkway (10) is not in use. The bridge elements (50) are designed, together with the floating elements (60A, 60B) to be unfolded and folded up in a zigzag concertina type formation. The invention also relates to applications of the construction to combine with land areas separated by a strait or a river where there is, for example, heavy traffic.

14 Claims, 9 Drawing Sheets

CONSTRUCTION OF A WALKWAY

TECHNICAL AREA OF THE INVENTION

The present invention relates to a floating walkway construction, for transport of people and goods between installations at sea and on land, or between two floating installations, such as ships, or between two land areas, such as across a river or a strait or between islands. Furthermore, the invention relates to methods to unfold and retract such floating walkway constructions. Furthermore, the invention relates to methods to produce floating walkways. In addition, the invention relates to different applications of the walkway construction.

BACKGROUND OF THE INVENTION

Walkways have been known for many years. For example, a previously granted patent in Great Britain GB 353 257 (from 1930) describes a construction for loading and unloading a ship. The construction comprises a pontoon adapted to be anchored in the vicinity of the ship and a gangway adapted to couple the pontoon to a point connected to land. On land, a universal coupling is used and also a universal coupling is used at the pontoon so that the gangway shall be able to be swung out to the ship and be pulled back and be parked in parallel along the shore.

This construction has several disadvantages. It takes up too much space in harbour areas and the ship must still lie very close to land corresponding to the length of the gangway which is pushed out. As a consequence, the construction is not normally used in harbours today as it is more common that the gangway has a rolling support from the harbour and is rolled out when used to be connected to a ship. Furthermore, it is necessary that the ship is manoeuvred very close to the edge of the pier, something which can be technically difficult in today's modern harbours.

DEFINITION OF THE INVENTION

An aim of the present invention is to provide a more suitable and advantageous way to implement a connection between land and a ship which lies near land.

According to a first aspect of the invention, a floating walkway construction is described, characterised in that it comprises bridge elements coupled in between floating elements fitted with horizontal and vertical segments so that the floating elements can be pulled out in use to connect the installation, and folded up when the walkway is not in use, as defined in claim 1.

The invention is advantageous because the walkway can be folded up into a compact shape, and can also be pulled out into a relatively long, zigzag concertina shape to be coupled to either a ship or an adjoining land area, for example, across a strait, a river, or between two islands.

The invention is advantageous because the bridge elements and the floating elements of the walkway are coupled together via horizontal and vertical segments which makes it possible for the walkway to be folded out a relatively great distance from the coast, and that the walkway can be pulled back into a compact form on land, namely in a concertina-type movement.

Alternatively, the flexible, floating walkway is constructed so that the bridge elements are designed, together with the floating elements, to unfold and fold up in a zigzag concertina-type formation.

According to one embodiment, the flexible, floating walkway is constructed such that the bridge elements are coupled to the floating elements in a way that prevents rotation of the bridge elements about their longitudinal axes.

According to one embodiment the flexible, floating walkway is constructed so that the floating elements are of an alternating type, and where a first type of floating element has segments that swing relative to the vertical axis when it is in use, and a second type of floating element has segments that swing relative to a horizontal axis when it is in use.

According to an embodiment, the flexible, floating walkway is constructed such that it includes fittings to pull out the walkway from a first installation and up to a second installation and to fold the walkway the other way, for example, to pull the walkway out to the ship and to fold the walkway back to the shore.

According to one embodiment, the flexible, floating walkway is constructed such that the walkway is adapted in use to receive several bridge elements, or that the bridge elements can be removed from it, to adjust the length of the walkway according to need.

According to one embodiment, the flexible, floating walkway is constructed such that one end of the floating element of the walkway is adjusted to be coupled to one side of the ship to provide access for personnel and/or goods to/from the installation/ship.

According to yet another preferred embodiment, the propulsion bodies of the outer floating element are comprised of a form of propellors or water-jet appliances, and with associated drive motors, to pull out and manoeuvre the walkway in to the ship to be coupled up, and back to the shore.

According to a second aspect of the invention a method is described as defined in claim 9, to connect a walkway construction according to a first aspect of the invention, characterised in that the method comprises:

a) that the ship is fastened relative to land with a distance of water between the ship (30) and land;

b) that the walkway is pulled out from a folded state from land in a zigzag way to a ship and thereafter to couple one end of a floating element of the walkway to one side or end of the ship.

According to a third aspect of the invention, a method is given as defined in claim 10; a method is given to couple a walkway construction according to the first aspect of the invention from a ship, characterised in that the method comprises steps:

a) to uncouple one end floating element of the walkway from the ship; and b) to fold the walkway in a zigzag way from the ship to a folded state parked next to a land area.

According to a fourth aspect of the invention a method is given which is defined in claim 11; a method to implement a bridge construction/walkway according to the first aspect of the invention, characterised in that the method comprises steps:

a) to couple, via articulated bridge elements between floating elements to form a zigzag formation of bridge elements that implement the walkway; and b) to couple one end of the formation to land.

The walkway construction according to the invention can be used to form a connection between two installations/ships, land and an anchored ship, or across a strait or a river between two land areas or between two islands where the construction is in a parked position on the one land bank, and it is taken into use by being pulled out over the strait/river and secured to the bank on the other side of the strait.

According to a preferred embodiment, bridge constructions are used as a transportation thoroughfare for people, goods and vehicles.

The components of the invention are adjusted to be combined as given in the subsequent claims.

DESCRIPTION OF THE DRAWINGS

The invention shall now be described in more detail with reference to the figures, in which.

DESCRIPTION OF EMBODIMENTS OF THE INVENTION

In summary the invention relates to a flexible, floating bridge construction/walkway set up to be connected between a ship and land. The walkway is comprised of a combination of bridge elements and floating elements fitted with horizontal and vertical segments with the result that the walkway has a zigzag shape in use, seen from above, that makes it possible for the walkway to be unfolded a relatively long distance from land, and to be folded up into a compact folded shape on land, namely in a so-called concertina type movement. It is advantageous to pull the walkway out to the ship with a boat and/or winch and be fastened to, for example, the side of the ship. Furthermore, the walkway is returned to a parked state by using winches. Alternative ways of moving the walkway are also possible, for example, via electric motors fitted on the walkway and/or propellors fitted on the walkway.

Figure 1:
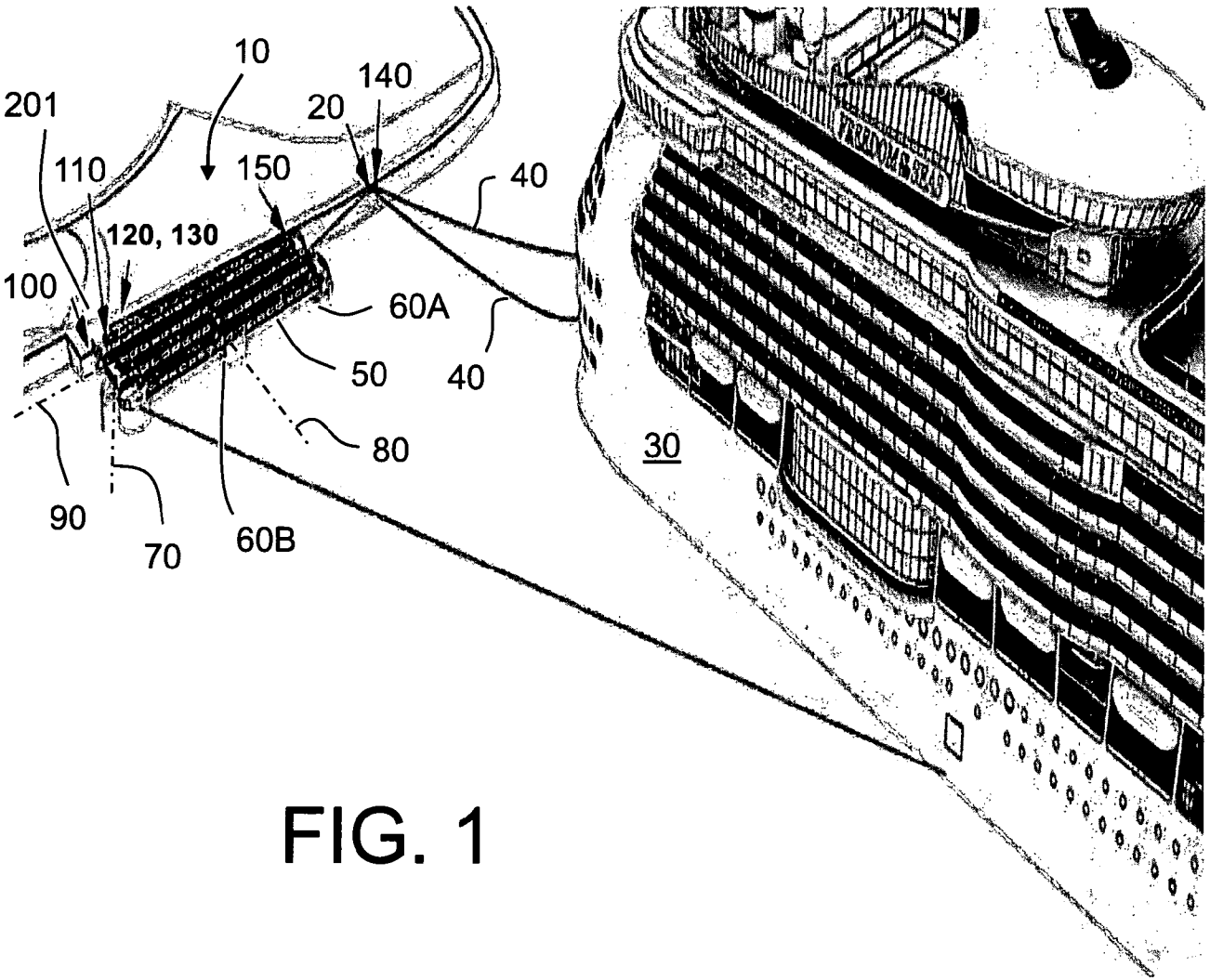
FIG. 1 is an illustration of a walkway that is folded up, namely in a parked state.

FIG. 1 shows an illustration of a walkway generally shown by 10. The walkway 10 is shown folded up, namely in a parked state in an appropriate walkway parking installation 201 (such as a harbour installation) that is constructed on land in connection to the shoreline 20. The walkway parking installation is formed so that it can store the folded walkway in a stable and secure way, as it comprises a rotary segment to which the innermost part of the gangway is anchored while the other end of the first floating element 60A can be placed next to a fender 150 when the gangway is parked, folded up. The walkway parking installation 201 comprises a land fastening point 110 and can further comprise a terminus for people and cargo that shall use the walkway out to, and from, for example, an anchored or moored ship at a distance from the shoreline.

Nearby, out on the sea, a ship 30 is fastened to land 20 with at least one or more hawsers 40. The walkway 10 comprises several bridge elements 50 that are coupled together in a zigzag formation as shown in FIG. 1. Furthermore, the walkway 10 includes an alternating sequence of floating elements 60A, 60B that have segments at each end and which can rotate about a vertical axis 70 and a cross-horizontal axis 80, respectively, as shown. The bridge elements 50 are prevented from rotating about their longitudinal axis 90. A first end 100 of the walkway 10 is connected to a land fastening point 110 and comprises a safety fence/safety banister 120 and a hydraulic installation 130 for a winch and a yardarm, for example, to supply the walkway 10 with high pressure hydraulic fluid to a hydraulic motor. FIG. 1 shows also, at least, one bollard 140 to fasten the, at least, one or more hawsers 40 from the ship 30 and to pull in the hawsers 40 and thereby to hold the ship 30 in place in relation to land 20. Furthermore, a fender 150 is included for the parking of the walkway 10 when it is folded together.

Figure 2:
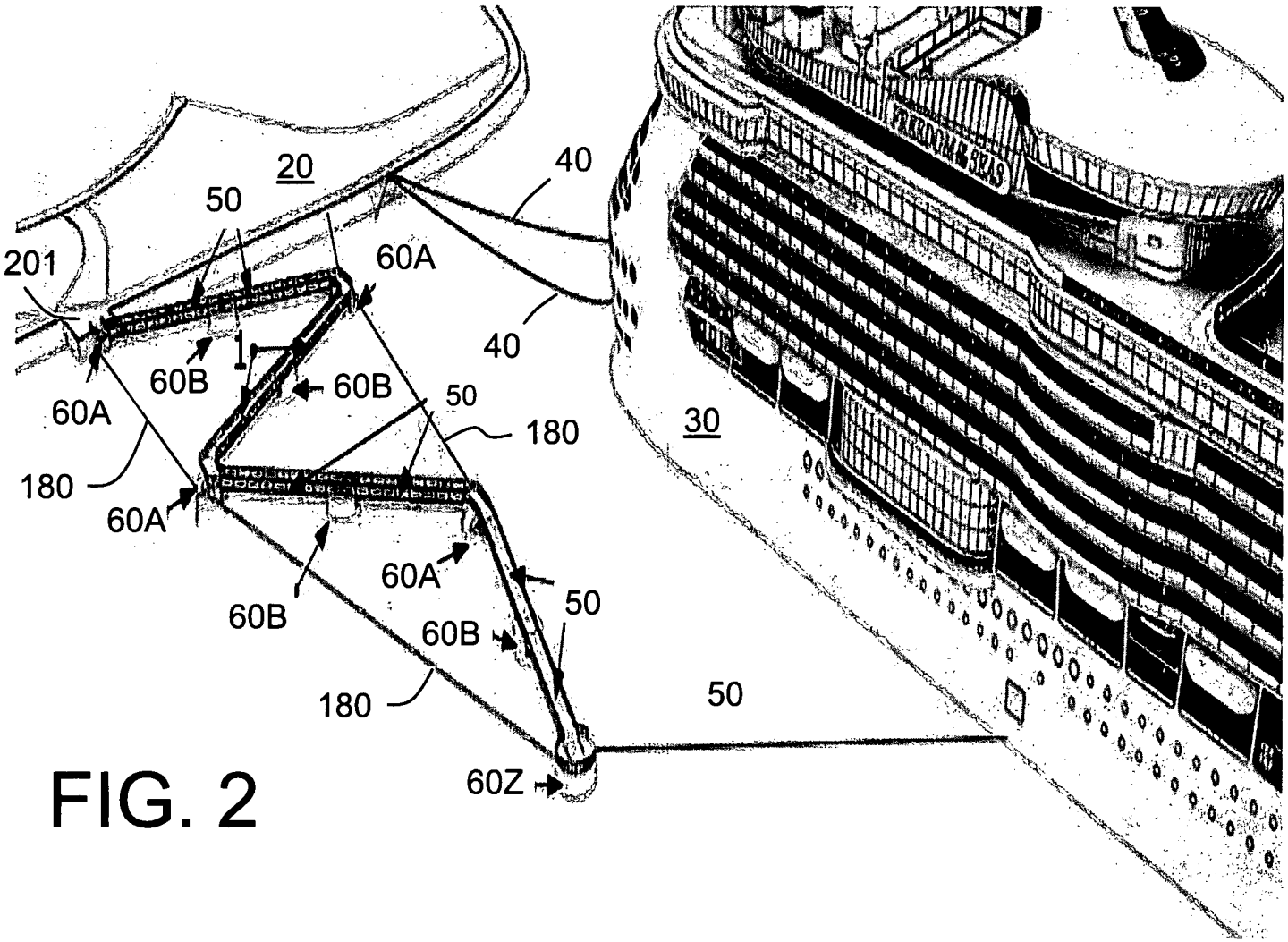
FIG. 2 is an illustration of the walkway in FIG. 1 pulled out halfway.
Figure 4:
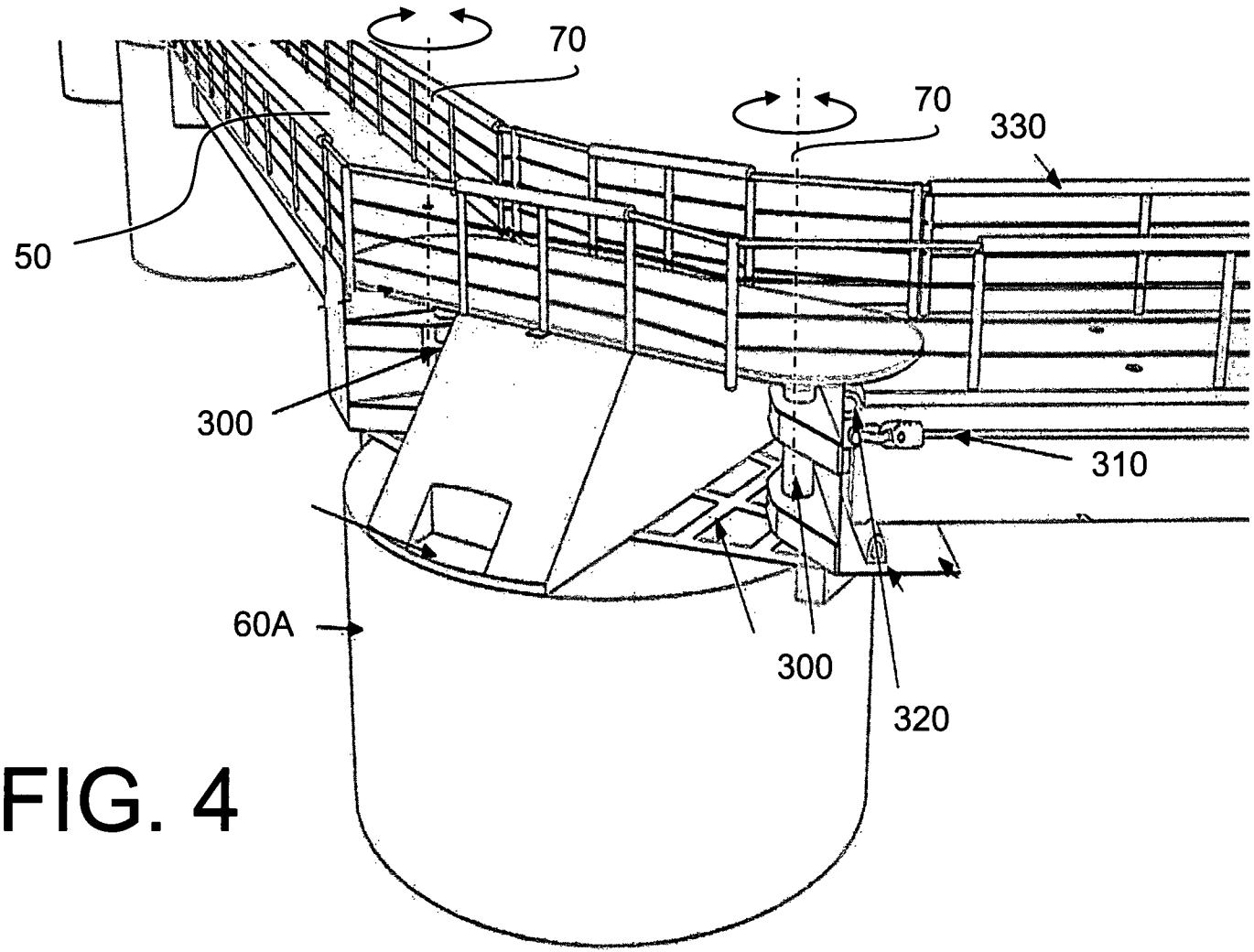
FIG. 4 is an illustration of a floating element with a horizontally rotating segment in perspective angle.

From a folded state of the walkway 10 as shown in FIG. 4, the walkway 10 can be partially unfolded as shown in FIG. 2. Here, one can clearly see the bridge elements 50, the floating elements 60A, 60B and the corresponding segments. Winch lines 180 are included and connected to the ends of the bridge elements 50 to be used when the walkway 10 shall be pulled back into a parked state as shown in FIG. 1. An outer floating element 60Z is advantageously pulled out to the ship 30 with help from a support boat (not shown). The boat can also be used advantageously to pull the hawsers 40 to land 20 and thereafter up onto the land if this is required. Alternatively, the floating element 60Z is fitted with propellors or water jet installations to pull out and manoeuvre the walkway 10 to the ship and back ashore.

As illustrated, in FIG. 4, each bridge element 50 is of a rectangular shape to define a path of elongated length and width for the passage of people and goods.

Figure 3:
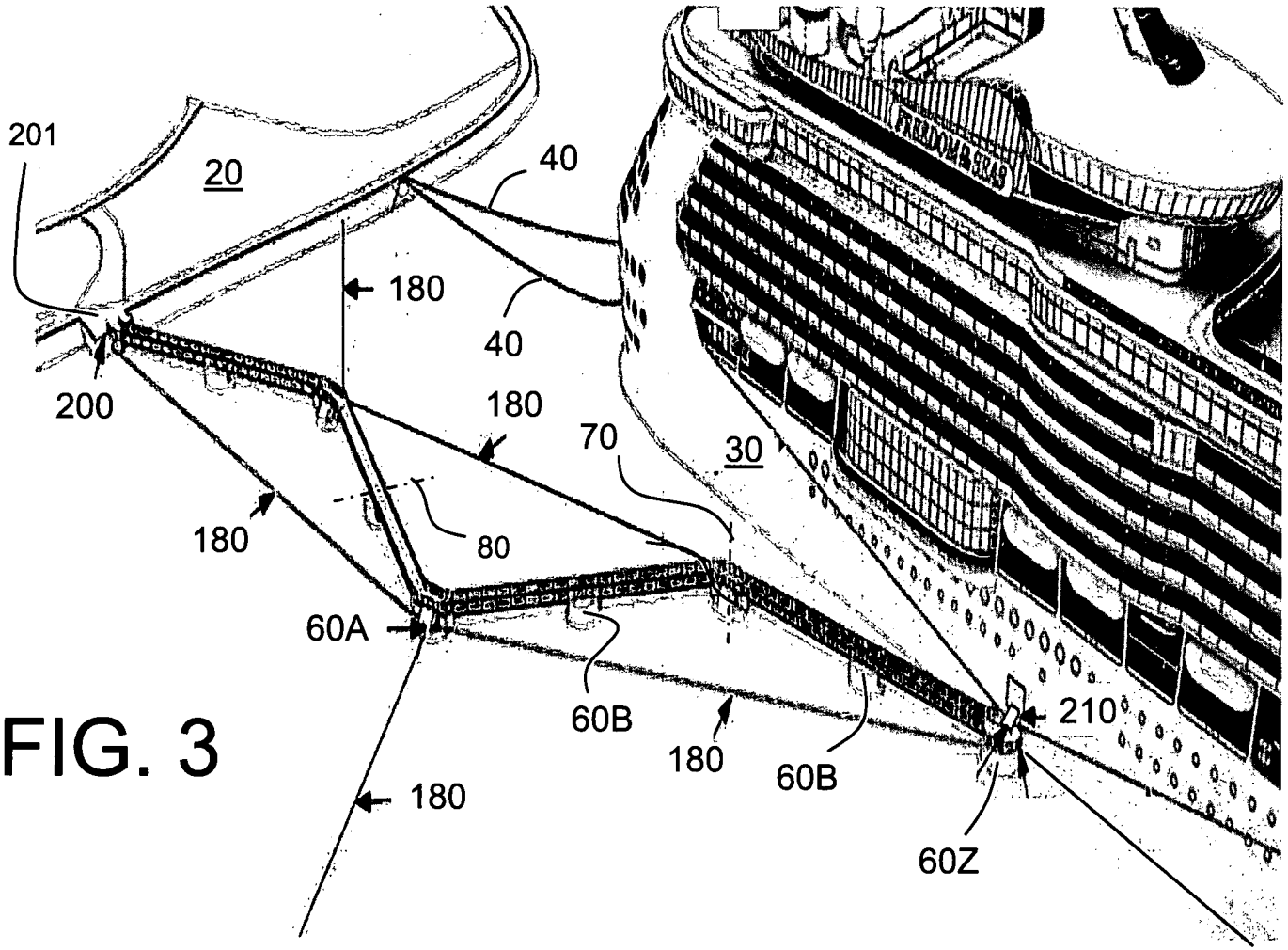
FIG. 3 is an illustration of the walkway in FIG. 1 in an operative state, fastened to the side of a ship.

FIG. 3 shows the walkway 10 fastened to the side of the ship 30 in an operative state, marked with winches 200, winch lines 180, hawsers to fasten the walkway 10 to the side of the ship 30, and also a gangway 210 between the ship 30 and the walkway 10. It is an advantage that the walkway 10 is coupled in use, not unfolded to its fullest extent, to the ship 30 so that the walkway 10 is adapted to accommodate movements of the ship 30 relative to the coast 20, namely that a movement safety margin is included to avoid that the walkway 10 becomes damaged.

FIG. 4 shows one of the floating elements 60A with a rotary segment 300 in perspective with details. As mentioned, the rotary segment 300 is set up to rotate about the vertical axis 70. Also shown are cribs for fastening of the bridge elements 50. Furthermore, tension wires 310 are shown to clamp the bridge elements 50 securely between the floating elements 60A, 60B. Rubber cushions 320 are included to provide more flexibility to the movements. Furthermore, a railing 330 is included to define the walkway 10 for pedestrians when the walkway is used. The walkway 10 comprises securing points for a winch and mounting base for the segment mechanism.

Figure 5A:
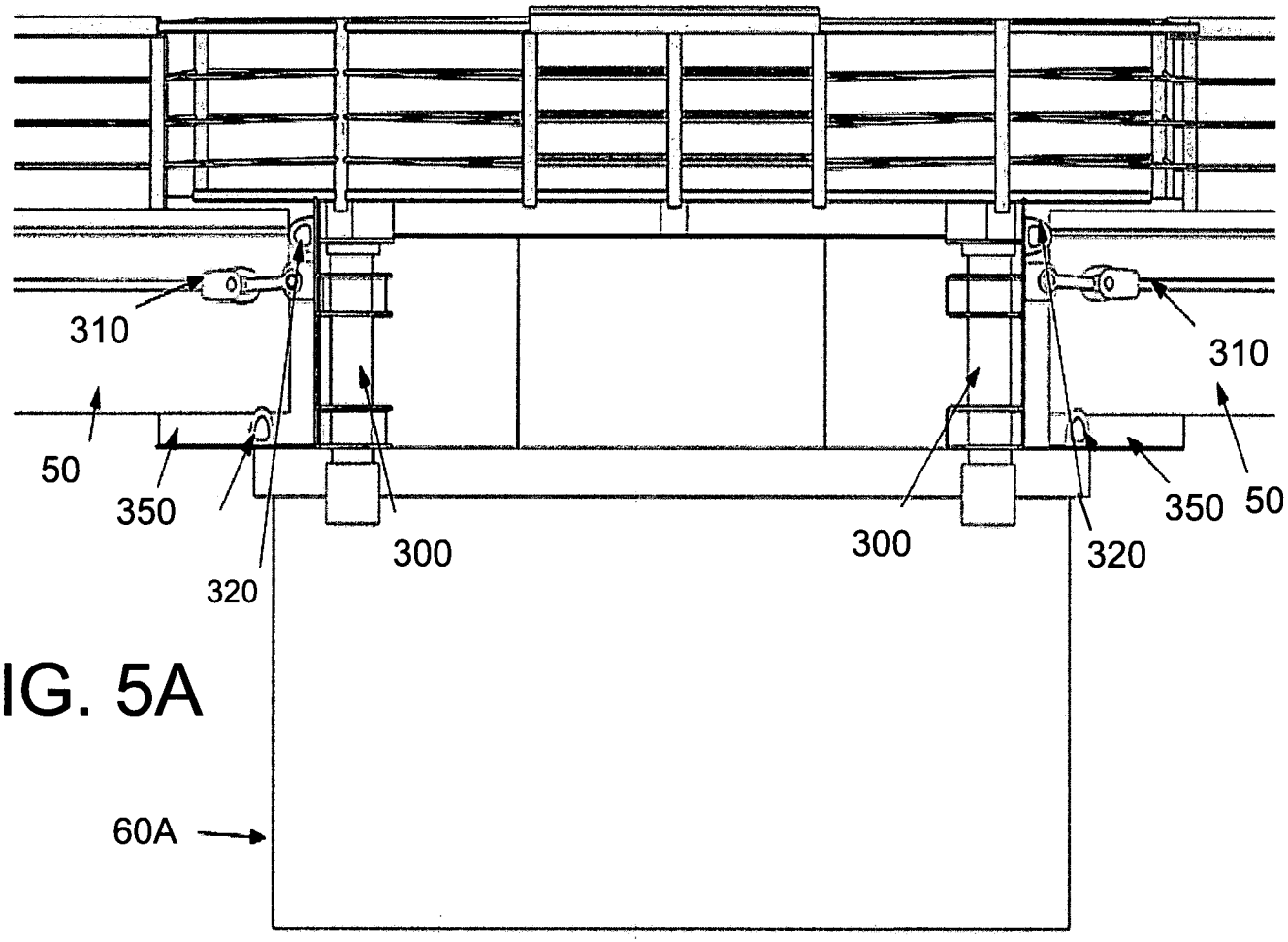
FIG. 5A is an illustration of a section of the floating element in FIG. 4, in which the floating element is fitted with a horizontally rotating segment.
Figure 5B:
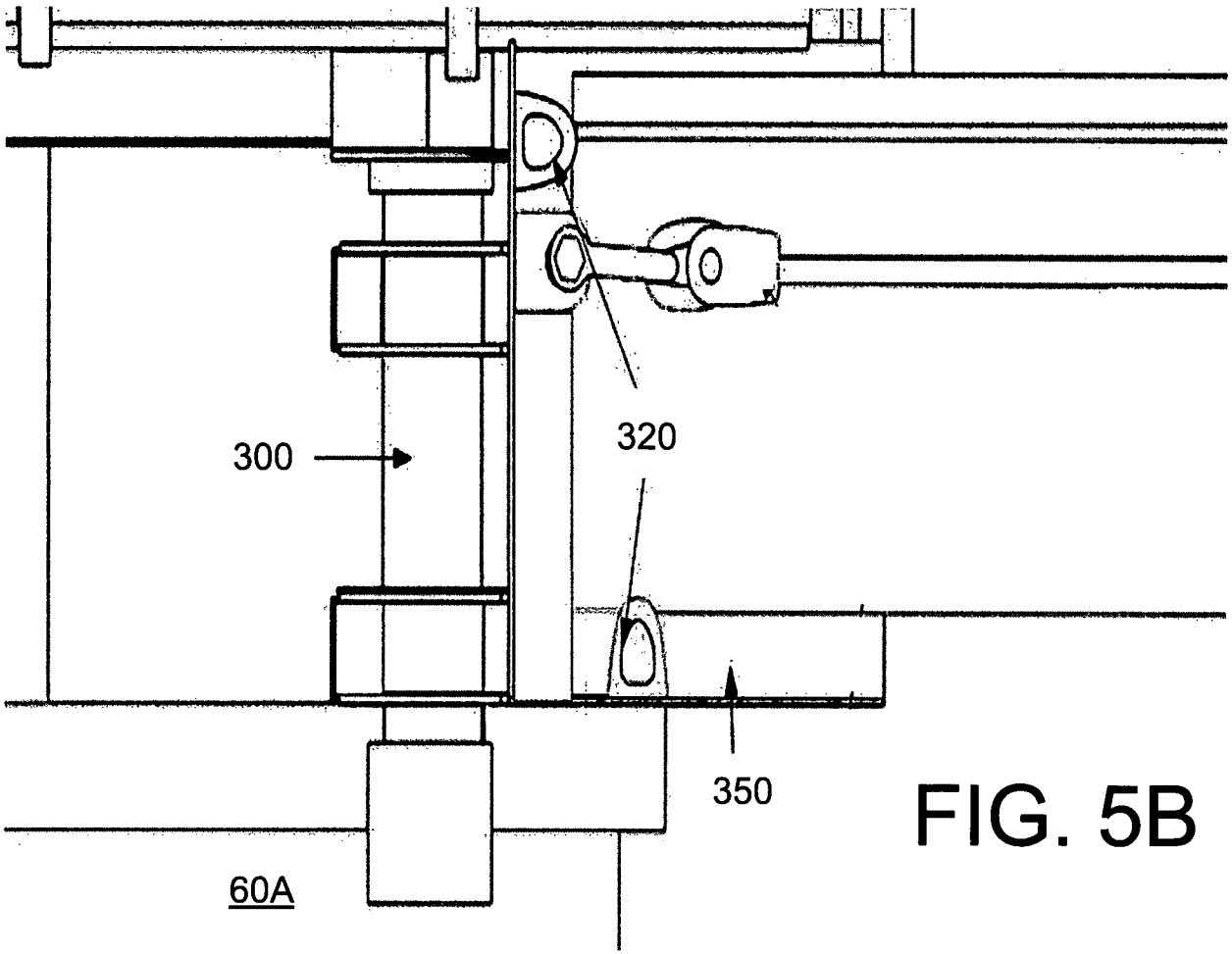
FIG. 5B is an illustration of an enlarged section of the rotating segment of the floating element.
Figure 6:
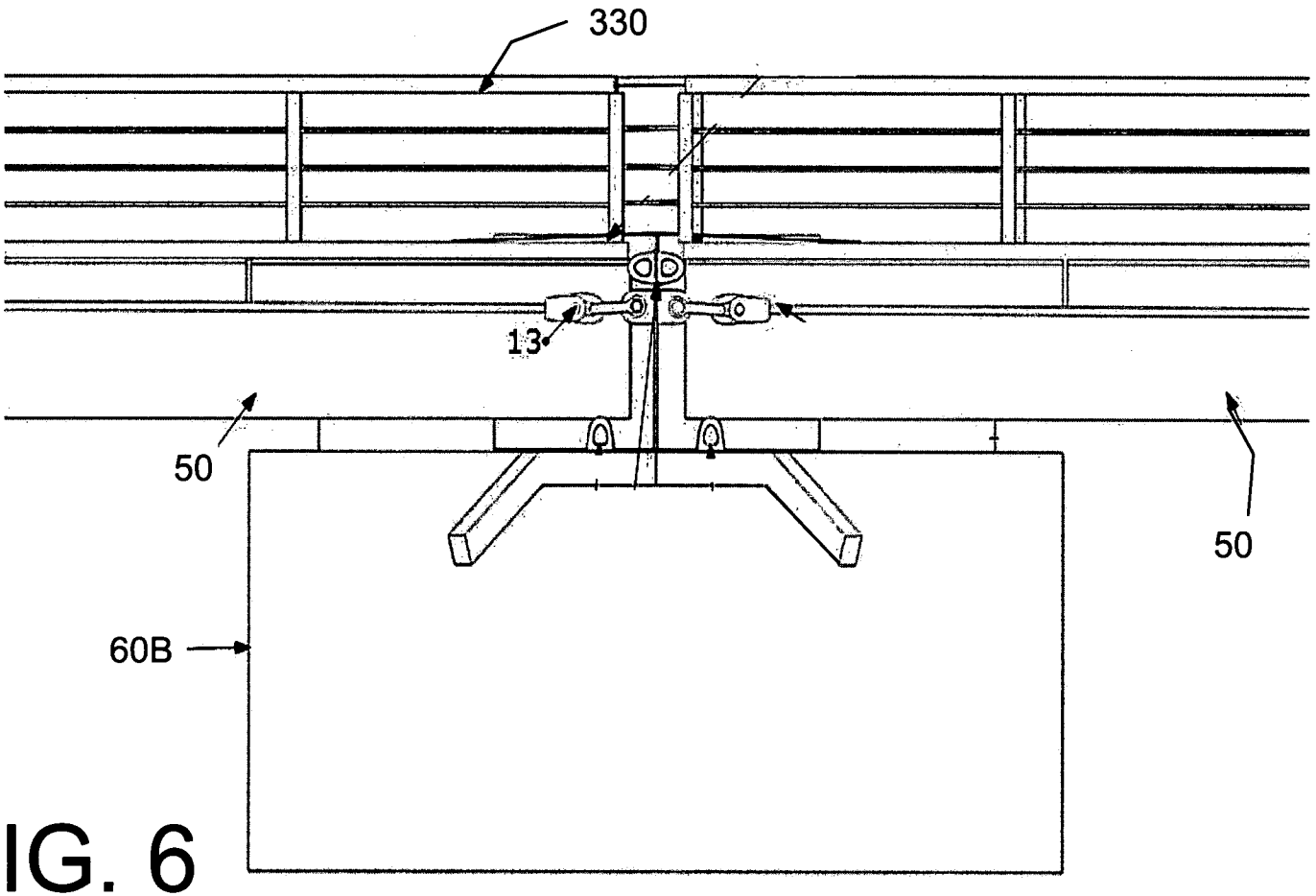
FIG. 6 is an illustration of a section of the floating element with vertical segments and corresponding details.

FIG. 5A shows a section of the floating element 50 in FIG. 4 with a rotary segment. Shown in the section is the floating element 60A, a crib 350 for fastening of the bridge element 50, a horizontal segment for rotating about the vertical axis 70, the tension wires 310 to clamp the bridge element 50 between the floating elements 60A, 60B and also the rubber cushions 320. FIG. 5B shows an enlarged section of a rotary segment with details. FIG. 6 shows a section of a floating element 50 of the walkway 10 and corresponding details. The bridge element 50 is coupled to a floating element 60B with the help of a crib for fastening of the bridge element 50. Also included are rubber cushions, railings and mounting base for the segments.

Figures 7A, 7B:
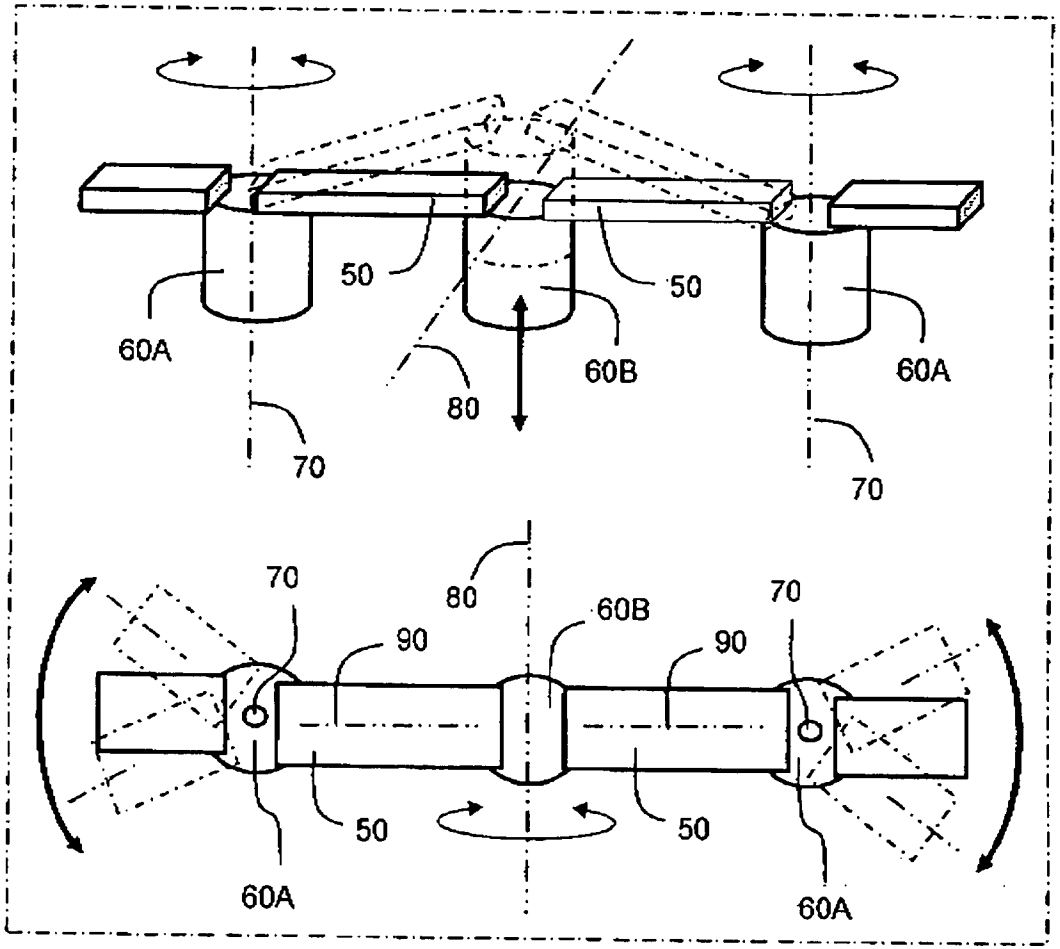
FIG. 7A is a perspective view of the manner of operation of the walkway with floating elements that either rotate horizontally or vertically.
FIG. 7B is a top view of the walkway of FIG. 7A.
Figure 7C:
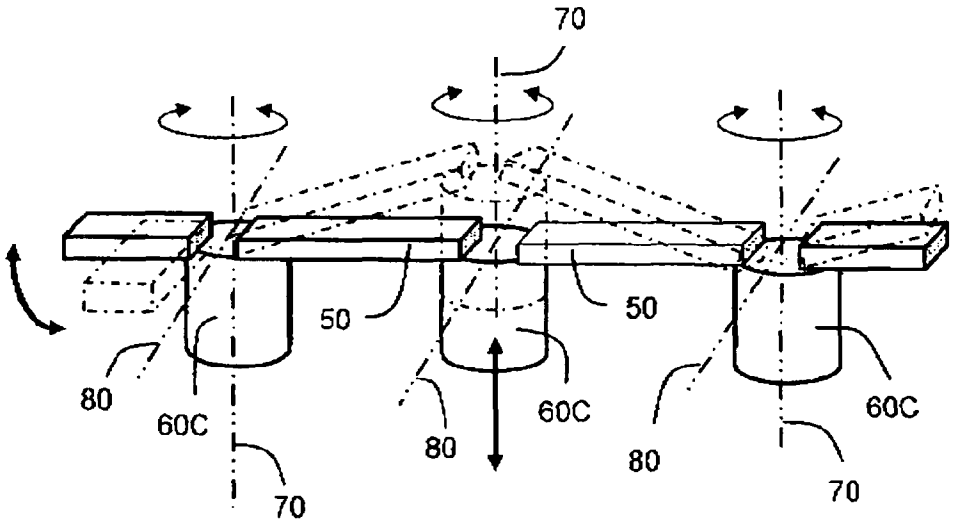
FIG. 7C is a perspective view of the manner of operation of the walkway with floating elements that rotate both horizontally and vertically.

FIG. 7 shows the operating principle for the walkway 10 with regard to the rotary movement. Alternatively, the bridge elements 50 are fastened to floating elements 60C via segments that can rotate both horizontally and vertically, but prevent the bridge elements 50 rotating about their longitudinal axes 90 as shown at the bottom of FIG. 7.

As mentioned, at the transition between the bridge elements 50 and the segments, a walkway and railing are arranged to avoid damages from pinching. Safety is thereby increased. The walkway 10 can possibly be fitted with at least one of: Special railings, ceiling, light arrangement, sound arrangement, seats, or different types of conveyor belts to transport people and/or goods.

The concept of the flexible walkway 10 is a reasonable and environmentally friendly alternative to the standard, well-known and costly cruise ship piers. Furthermore, the concept removes the need for use of tender vessels to transport people between the ship and the shore. The walkway 10 has the considerable advantage that it requires minimal installation costs and minimal environmental interference of the shore zone 20.

When the walkway 10 is not in use, it will lie parked, namely folded up, by the shore side, namely along the shoreline 20 as shown in FIG. 1, for example, and can be used for other activities, such as, for example, a part of the strand promenade, a fishing spot, a mooring point for boats and the like. When it is in use, the safety railing with a guard will limit access with regard to regulations for harbours with ships from abroad. The walkway 10 can advantageously have a free length as one can then build out the bridge elements 50 according to need, namely updating later during use after the original installation.

A method to use the walkway 10 will now be described. When the walkway 10 is used, the ship 30 is placed with the stern towards the shore and fastened with the hawsers 40 to land and hawsers to an anchor or buoy for fastening of the bow. The ship 30 preferably keeps its engines running and is ready to be able to manoeuvre with the propellors, or to leave the harbour quickly, for example, in 15 minutes. Such quick implementation and retraction of a walkway is not previously known.

When the ship 30 is securely moored by the shore 20, the support boat pulls out a pulling out line from the walkway 10 to a hatch or the like in the side of the ship 30. A winch on an end pontoon, namely the floating element 60Z, pulls the walkway 10, namely the pier, out to the hatch and hawsers, alternatively magnet and/or vacuum, fastens the end pontoon to the side of the ship 30. Alternatively, the support boat or the ship 30 itself can pull the end pontoon in place at the side of the ship 30. The ship 30 preferably uses its own gangway between the hatch at the side of the ship 30 and the end pontoon, namely the floating element 60Z.

The walkway 10 is advantageously designed to withstand a weight concentration in the form of a downward oriented pressure of at least 400 kg/m$^2$ and, in addition to people, it shall be able to withstand vehicles, for example, vehicles for the disabled and/or small vehicles to deliver consumer goods to the ship 30. Furthermore, the walkway 10 is made sufficiently robust to withstand current in the sea of a speed of 0.75 meter/second and wind up to a strong breeze with a wave height up to 1.5 meters. When the walkway 10 is fastened to the ship 30 a winch is preferably used with an anchor line that regulates the distance from the ship 30 automatically. As an alternative to a winch, an anchor line with a weight can be used to control the walkway 10.

To pull the walkway 10 into a parked state as shown in FIG. 1, a separate winch can be advantageously used, namely the winch on the ship 30 is not used.

Modifications of the embodiment examples of the invention described in the above are possible without deviation from the extent of the invention defined by the subsequent claim.

Expressions such as "included", "comprising", "incorporate", "consisting of", "have", "are", which are used to describe the present invention, are meant to be interpreted in a non-exclusive way, namely such that for elements, components or elements that are not explicitly described also to be present. References to singular are also interpreted to deal with plural.

Numbers included in brackets in the claims in the accompanying documents are meant to help the comprehension of the claims and ought not to be interpreted in any way to limit the field covered by these statements.

Alternative Application Areas:

The walkway construction can be used for tasks other than transferring people and goods between land and a ship.

One can also visualize that the walkway is used as a bridge across a strait or a river between two land areas or two islands, where the construction is in a parked state on the one land bank with the necessary land installation. When it is taken into use it is pulled across the strait and secured to the land bank on the other side and prepared for traffic. This is very relevant when traffic by larger ships shall pass through the strait. Then, the walkway is moved to a parked position, the ship passes through the strait and the walkway can be set out again to form the connection between the two land areas for the passage of people and goods. It can also be used as a drive way where both cars and lorries can drive on the bridge, thus it must then be constructed to withstand such transport.

The invention claimed is:

1. A flexible floating walkway to make it possible to safely transfer people and/or goods between installations at sea, such as ships and land characterised in that the floating walkway comprises bridge elements connected between floating elements fitted with horizontal and vertical segments, such that the floating elements can be pulled out in use to couple together the installations and folded up when the gangway is not in use and characterised in that the floating elements are of the alternating type and in which a first type of floating element has segments that rotate during use relative to a vertical axis and a second type of floating element has segments that rotate during use relative to a horizontal axis.

2. A flexible floating walkway as defined in claim 1, characterised in that the bridge elements are designed, together with the floating elements to be unfolded and folded in a zigzag, concertina type formation.

3. A flexible floating walkway as defined in claim 1 characterised in that the bridge elements are coupled to the floating elements in a way which prevents rotation of the bridge elements about their longitudinal axes.

4. A flexible floating walkway as defined in claim 1 characterised in that the walkway includes fittings to pull the walkway out from a first installation and up to a second installation and to fold the walkway the other way.

5. A flexible floating walkway as defined in claim 1 characterised in that the walkway is adjusted during use to receive several bridge elements, or have bridge elements removed from it to adjust the length of the walkway according to need.

6. A flexible floating walkway as defined in claim 1 characterised in that an end floating element of the walkway is adjusted to be coupled to one side of a floating installation, such as a ship to give access for people and/or goods to/from the installation/ship.

7. A flexible floating walkway as defined in claim 1 characterised in that the outer floating element comprises propulsion bodies in the form of propellers or a water-jet appliance to pull out and maneuver the walkway up to the ship and back to land again.

8. A method to couple a walkway construction according to claim 1 to a ship, characterised in that the method comprises:

a) that the ship is fastened relative to land with a distance of water between the ship and land; and b) that the walkway is pulled out from a folded state from land in a zigzag way to the ship and thereafter to couple one end of a floating element of the walkway to a side or end of the ship.

9. A method to couple a walkway construction according to claim 1 to a ship, characterised in that the method comprises:

a) to uncouple an end floating element of the walkway from the ship; and b) to fold the walkway in a zigzag manner from the ship to a fold state parked next to land.

10. A flexible floating walkway for transferring people and/or goods between a ship at sea and land comprising a plurality of elongated bridge elements, each said bridge, element being coupled to an adjacent bridge element of said plurality of bridge elements to pivot about a vertical axis and being of a rectangular shape to define a path of elongated length and width for the passage of people and goods; and a plurality of floating elements supporting said plurality of bridge elements for movement of said bridge elements between a folded up parked position and an extended zig-zag position.

11. A flexible floating walkway as set forth in claim 10 further comprising one of a propeller installation and a water jet installation on a outermost floating element of said plurality of floating elements for moving said plurality of floating elements between said parked position and said extended zig-zag position.

12. A flexible floating walkway as set forth in claim 10 wherein said floating elements are of the alternating type and in which a first type of floating element has segments that rotate during use relative to a vertical axis and a second type of floating element has segments that rotate during use relative to a horizontal axis.

13. A flexible floating walkway as set forth in claim 10 wherein each of said floating elements has segments that rotate both horizontally and vertically.

14. A flexible floating walkway as set forth in claim 10 further comprising a railing on each side of a respective bridge element to define a walkway for people.

* * * * *